US010327522B2

(12) United States Patent
Lustgarten

(10) Patent No.: US 10,327,522 B2
(45) Date of Patent: Jun. 25, 2019

(54) BAG EXPANDING ASSEMBLY

(71) Applicant: Karina Silvana Lustgarten, Buenos Aires (AR)

(72) Inventor: Karina Silvana Lustgarten, Buenos Aires (AR)

( * ) Notice: Subject to any disclaimer, the term of this patent is extended or adjusted under 35 U.S.C. 154(b) by 570 days.

(21) Appl. No.: 14/613,792

(22) Filed: Feb. 4, 2015

(65) Prior Publication Data

US 2016/0219995 A1 Aug. 4, 2016

(51) Int. Cl.

| | |
|---|---|
| ***A45C 13/10*** | (2006.01) |
| ***A45C 3/06*** | (2006.01) |
| ***A45C 13/00*** | (2006.01) |
| ***A45C 13/02*** | (2006.01) |

(52) U.S. Cl.

CPC ..... *A45C 3/06* (2013.01); *A45C 13/004* (2013.01); *A45C 13/02* (2013.01)

(58) Field of Classification Search

CPC ..... A45C 3/06; A45C 7/0036; A45C 7/0077; A45C 3/00; A45C 5/14; A45C 7/0095

USPC ..... 190/107, 100, 109, 111; 150/105, 106, 150/107, 110, 111–113, 127; 383/127; 128/870; 602/6, 12, 13

See application file for complete search history.

(56) References Cited

U.S. PATENT DOCUMENTS

| | | | | |
|---|---|---|---|---|
| 4,185,673 | A | 1/1980 | Daniello | |
| 4,526,280 | A * | 7/1985 | Taylor | B65D 77/0406 150/154 |
| 4,917,505 | A * | 4/1990 | Bullard | A45C 9/00 190/1 |
| 5,138,728 | A | 8/1992 | Aston | |
| 5,259,674 | A | 11/1993 | Hedaya et al. | |
| 5,542,767 | A | 8/1996 | Hedaya et al. | |
| 5,934,808 | A | 8/1999 | Ozeri et al. | |
| 6,199,232 | B1 * | 3/2001 | Kocivar | A47G 9/0207 2/69.5 |
| 6,296,094 | B1 * | 10/2001 | Knecht | A45C 7/0095 190/107 |
| 6,550,967 | B2 | 4/2003 | Hedaya | |

(Continued)

FOREIGN PATENT DOCUMENTS

| | | |
|---|---|---|
| DE | 202013105763 | 2/2014 |
| WO | WO2016125103 A1 | 8/2016 |

*Primary Examiner* — Fenn C Mathew
*Assistant Examiner* — Cynthia Collado
(74) *Attorney, Agent, or Firm* — Malloy & Malloy, PL

(57) ABSTRACT

An assembly structured to maintain a bag in an expanded orientation when inserted therein and when the bag is not in use. A base is formed from a compressible, expandable, substantially cushioning material including inner and outer surfaces having connectors disposed thereon. The base includes at least one primary section and one or more secondary sections, respectively comprising a plurality of primary segments and secondary segments. Longitudinal and transverse fold lines extend between and interconnect adjacent ones of the primary and secondary segments and facilitate the selective disposition of the base into any one of a plurality of folded, operative orientations, which substantially correspond to the configuration of the bag in which the basis inserted. The removable attachment of correspondingly positionable connectors at least partially determine, which of the plurality of folded, operative orientations the base will assume.

26 Claims, 8 Drawing Sheets

(56) References Cited

U.S. PATENT DOCUMENTS 6,637,485 B1 * 10/2003 Sartena ..... A45C 3/06 150/101
6,698,927 B2 3/2004 Hedaya et al.
6,719,711 B1 * 4/2004 Islava ..... A61F 5/05816 128/DIG. 20
6,769,807 B2 8/2004 Bayard
7,108,425 B2 9/2006 Temkin
D572,481 S * 7/2008 Metzger ..... D3/299
7,600,619 B2 * 10/2009 Sapyta ..... A45C 7/0054 190/107
D760,494 S * 7/2016 Harvey-Pankey ..... D3/232
2002/0126920 A1 9/2002 Mogil
2003/0089749 A1 * 5/2003 Valdez-Campbell ..... A45C 7/0095 224/153
2004/0069384 A1 * 4/2004 Bayard ..... A45C 13/004 150/113
2004/0187988 A1 * 9/2004 Andrews ..... A45C 3/08 150/127
2005/0016808 A1 * 1/2005 Sapyta ..... A45C 7/0057 190/107
2006/0096681 A1 * 5/2006 Khubani ..... A45C 13/004 150/113
2006/0260046 A1 * 11/2006 Landay ..... A47G 9/086 5/413 R
2007/0089818 A1 * 4/2007 Bigel ..... A45C 3/06 150/113
2008/0137999 A1 6/2008 Chi
2008/0251087 A1 * 10/2008 Richardson ..... A61F 5/0193 128/876
2009/0184011 A1 * 7/2009 Krakauer ..... A45C 3/004 206/278
2012/0055959 A1 * 3/2012 Hale ..... A45C 3/06 223/84
2013/0081742 A1 * 4/2013 McLaughlin ..... A45C 13/002 150/154
2015/0020936 A1 * 1/2015 Donaldson ..... A45C 7/0059 150/110

* cited by examiner

BAG EXPANDING ASSEMBLY

BACKGROUND OF THE INVENTION

Field of the Invention

This invention is directed to an assembly for at least temporarily maintaining a bag such as, but not limited to, a handbag in an expanded orientation, typically when the bag is not being used. A base of the expanding assembly is disposed in an operative position by being inserted within the bag after being arranged in any one of a possible plurality of folded, operative orientations, which at least partially corresponds to a shape of the bag.

Description of the Related Art

It is well accepted that one of the more important accessories used by women is a handbag. It is equally well known that the average woman may possess a relatively large number of handbags each of which may be intended for use for different occasions or events. Similarly different handbags are commonly used depending on the season, a woman's clothing and a variety of other factors. Further and by way of example, most women have one or more frequently used handbags carried on a day-to-day basis. In contrast, formal or special events frequently require the use of a more formal style handbag, which is typically smaller and intended to contain a relatively few or limited number of items.

As is also well known, handbags and like bag structures carried by both women and men come in a variety of different sizes, shapes, etc. Similarly different handbags are often formed from a variety of different materials. A significant number of handbags are formed from a flexible material. Other than the handbags used on a "day-to-day" basis, most of the handbags found in a woman's collection are used on a relatively infrequent basis. As a result, many handbags or like bag structures require storage and safekeeping in a manner which prevents their deterioration. Moreover, when handbags or like bag structures are formed from a flexible material, it is common for such handbags to at least partially collapse or fold upon themselves when not being used.

In order to avoid damage of the type referred to, it is known to fill or "stuff" the bags with a variety of different disposable materials such as paper, cardboard, cloth or other typically disposable material "fillers", in an attempt to maintain the handbag in an expanded orientation. It is recognized that maintenance of a flexible material bag in its expanded orientation serves to prolong the appearance and operable, useful life of the bag. "Bag stuffers" are also found in retail establishments which are associated with the sale and display of handbags, luggage, or other type of bag structures which have a tendency to collapse or fold upon themselves when not being carried or otherwise not in use.

In an attempt to overcome the problems, disadvantages and general untidiness associated with the use of paper, cardboard or like material, specifically structured bag stuffers are known and have been developed for commercial use and distribution. While structures of this type are assumed to be at least minimally operative for their intended purpose, such conventional expanding devices lack certain operative features which restrict their use with bags of different sizes, shapes, etc. More typically, known expanding or stuffing structures of this type are generally shaped to accommodate a single style, size or shape of a bag. As a result, an individual is frequently required to purchase a relatively large number of such bag expanders, each of which may be of a different size or shape, in order to maintain different ones of a plurality of bags in a user's collection in the preferred, expanded orientation during storage, travel, display or other periods of non-use.

Accordingly, there is a need in this area for an assembly and/or device structured to maintain a handbag or other type of bag structure in an expanded orientation when inserted therein. Preferably, such a proposed expanding assembly includes a base formed of a lightweight, cushioning, expandable and compressible material such as, but not limited to, and ultralight memory foam. Therefore, the base of such a proposed expanding assembly should be sufficiently flexible to facilitate it being folded upon itself into any of a possible plurality of different shapes or sizes. As a result, an individual would be able to fold the proposed expanding base into an operative orientation, which substantially corresponds in size and shape to the handbag or other bag structure with which it is intended for use. Accordingly, a user would be able to use one and/or a relatively few of such proposed expanding assemblies with a plurality of bags which may differ significantly in size, configuration, structure, material, etc. Therefore, many of the problems and disadvantages associated with known or conventional expanding structures or bag stuffers would be overcome. Further, such a preferred and proposed expanding assembly should be relatively inexpensive, have a long operable life and be easy to handle, manipulate and utilize.

SUMMARY OF THE INVENTION

The present invention is directed to an assembly structured to maintain a bag such as, but not limited to, a handbag or the like in an expanded orientation when inserted therein. As such, the assembly may be commonly referred to as a "bag stuffer" and is commonly used to maintain a proper shape, configuration, structural orientation, etc. of the bag when being stored, transported, etc.

More specifically, the assembly includes a base preferably formed of a lightweight, soft, foldable, compressible and responsively expandable material. By way of example only, the base may be formed of an ultralight memory foam or similar compressible material which expands substantially into its original shape when initially or repetitively compressed. Moreover, the compressible, expandable material may thereby have "cushioning" characteristics which further facilitate the protection of the bag and the maintenance thereof in its intended and/or original expanded shape. In addition, the base includes both an inner surface and an outer surface, each having a plurality of connectors disposed in predetermined arrays which are configured or structured to locate the inner and outer connectors in positions which facilitate the removable retention of the base in a predetermined folded orientation. The selective and removable interconnection of some of the connectors with predetermined others of the plurality of connectors will determine the overall "folded, operative orientation" the base will assume.

In addition, the connectors disposed on both the inner and outer surface may vary in structure and function. By way of example only, the plurality of inner and outer connectors may be in the form of hook and loop type fasteners commonly and commercially available under the trademark "Velcro". In the alternative or in addition thereto at least some of the plurality of inner and outer connectors they be metallic or other material having magnetic capabilities, which may also include a "snap-type" of attachment feature.

Accordingly, depending on which of the connectors are attached to one another, the base may assume any one of a possible plurality of folded, operative orientations, which substantially or at least partially corresponds to the inner and/or overall shape, dimension and/or configuration of the bag in which it is to be inserted. In more specific terms, the selective attachment of different ones of the connectors on both the inner and outer surface will allow a user to fold the base into any one of a variety of different folded, operative orientations. As a result, the user can effectively shape the base into different configurations dependent on the shape or configuration of the bag in which the base is to be inserted. Moreover, the base is then disposed in an operative position on the interior of a given bag, once the base is disposed into the folded, operative orientation which substantially corresponds to the shape of the given bag. When in the operative position, the folded, operative orientation of the base facilitates the maintenance of the bag into the expanded orientation, typically during periods of nonuse of the bag.

Further, each or at least a majority of the aforementioned folded, operative orientations are at least partially defined by the inner and outer surface of the base being folded, typically multiple times, about themselves. As a result, portions of the inner and outer surface of the base are folded in confronting engagement to themselves, resulting in at least a portion of the outer surface being disposed in an exteriorly exposed position. As will be apparent, the base will be removably maintained in the preferred or selected one of the plurality of possible folded, operative orientations, while in the operative position within the bag. This removable retention in the selected one of the folded, operative orientations is accomplished by removable attachment of at least some of the correspondingly positioned ones the connectors, disposed on the inner and outer surfaces of the base, as a result of the base being manipulated through different folding steps.

Additional structural and operative features include the base having at least one primary section preferably extending along a majority or an entirety of the longitudinal or other preferred dimension thereof. Similarly at least one but preferably a plurality of secondary sections extend along the length of the primary section, preferably on opposite longitudinal sides thereof and in immediate, laterally adjacent, relation thereto. Moreover, in at least one embodiment the base includes at least one secondary section disposed in laterally adjacent relation and extending along each, opposite longitudinal side of the primary section. In order to add additional versatility to the base in terms of facilitating the variety of operative orientations in which it may be formed, a plurality of the secondary sections may be disposed along the length of each of the opposite longitudinal sides of the primary section. As such, corresponding ones of the plurality of secondary sections are also disposed in laterally adjacent relation to one another.

The at least one primary section further includes a plurality of primary segments collectively and successively extending along the length thereof. As such the primary segments are disposed in successive, end-to-end, longitudinally adjacent relation to one another. Somewhat similarly, each of the one or more secondary sections includes a plurality of secondary segments extending along the corresponding length thereof in end-to-end, longitudinally adjacent relation to one another. In cooperation therewith and in order to facilitate the variable folding of the base into any one of the possible plurality of folded, operative orientations, the base includes a plurality of "fold lines".

Moreover, the plurality of fold lines includes one or more longitudinal fold lines as well as one or more transverse fold lines. The longitudinal fold lines extend along the length of and in interconnecting relation between laterally adjacent primary segments and secondary segments as well as between laterally adjacent secondary segments of the aforementioned primary and secondary sections. The transverse fold lines extend concurrently "through" both the primary section and the secondary sections in interconnecting relation to correspondingly positioned, longitudinally adjacent primary segments and longitudinally adjacent secondary segments. As such, the plurality of longitudinal and transverse fold lines are evident on and extend between the inner and outer surfaces of the base. Therefore, the existence and positioning of the plurality of fold lines relative to both the primary and secondary segments of the primary and secondary sections enhance the versatility of the base by allowing it to be selectively folded into any one of the aforementioned possible plurality of folded, operative orientations. As emphasized, the selected folded, operative orientation is intended to at least partially or substantially and sufficiently correspond to the interior and/or overall configuration of the bag so as to maintain the bag in the expanded orientation during storage or periods of non-use.

Yet additional structural features included in one or more preferred embodiments of the assembly of the present invention may include the provision of a handle or gripping structure disposed on the outer surface. The handle or gripping structure is preferably disposed in a readily accessible location when the base has been folded into the preferred operative orientation corresponding to the bag in which it is to be inserted. Also, one or more removable attachment structures such as, but not limited to, a spring-loaded snap hook type attachment device may also be connected to the base when it assumes the preferred folded, operative orientation. This will additionally serve to removably maintain it in the preferred or resulting operative orientation.

Therefore, the operative and structural features of the present invention of the type set forth herein, facilitate an enhanced versatility not found in known or conventional bag expanding assemblies. Such enhanced versatility is demonstrated by the ability to use the various preferred embodiments of the bag expanding assembly of the present invention with a variety of different types, structures and/or styles of bags. Structural variance in such bags may include, but is not limited to, bags having an open interior communicating with an open end of the bag. In contrast, the expanding assembly of the present invention may be used with bag structures including a compartmented and/or at least partially enclosed interior.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying Figures, the present invention is directed to an expanding assembly 10 for at least temporarily maintaining a bag in an expanded orientation, typically when the bag is not being used. Further, the bag with which the expanding assembly 10 may be used may vary in style, shape, dimension and be used for a variety of purposes. By way of example the different bags disclosed in the accompanying figures are represented as handbag of different size and/or shape. However, the versatility of the expanding assembly at 10 allows it to be formed in a variety of different folded, operative orientations such as, but not limited to those represented in FIGS. 1, 4E, 5 and 5A. As a result, the expanding assembly 10 of the present invention may be used with different type of bag structures and are not intended to be limited to a woman's handbag.

As indicated, the expanding assembly 10 may assume any one of a possible plurality of different folded, operative orientations, each of which at least partially corresponds to the configuration of a bag in which it is to be inserted in an operative position. In more specific terms, the expanding assembly 10 includes a base 12. When the base 12 is folded into a selected or predetermined folded, operative orientation, the overall, exterior configuration and/or size of the base 12 at least partially corresponds to at least the interior configurations and/or the overall size of the bag. Corresponding shapes and sizes of the folded base 12 and that of the bag with which it is to be used are sufficiently similar to effectively maintain the bag in a preferred expanded orientation. Therefore, the shape and size of the base when folded into the selected operative orientation does not have to be an exact equivalent of the size and shape of the bag with which it is to be used. Such an expanded orientation of the bag will preferably be the substantially similar to the expanded orientation the bag was designed to assume when it was initially manufactured or produced. As a result, when the bag is not in use, such as during storage, travel, display, etc., its maintenance in the expanded orientation will eliminate or significantly reduce the possibility of creases, folds or other types of damage to the bag.

Figure 2:
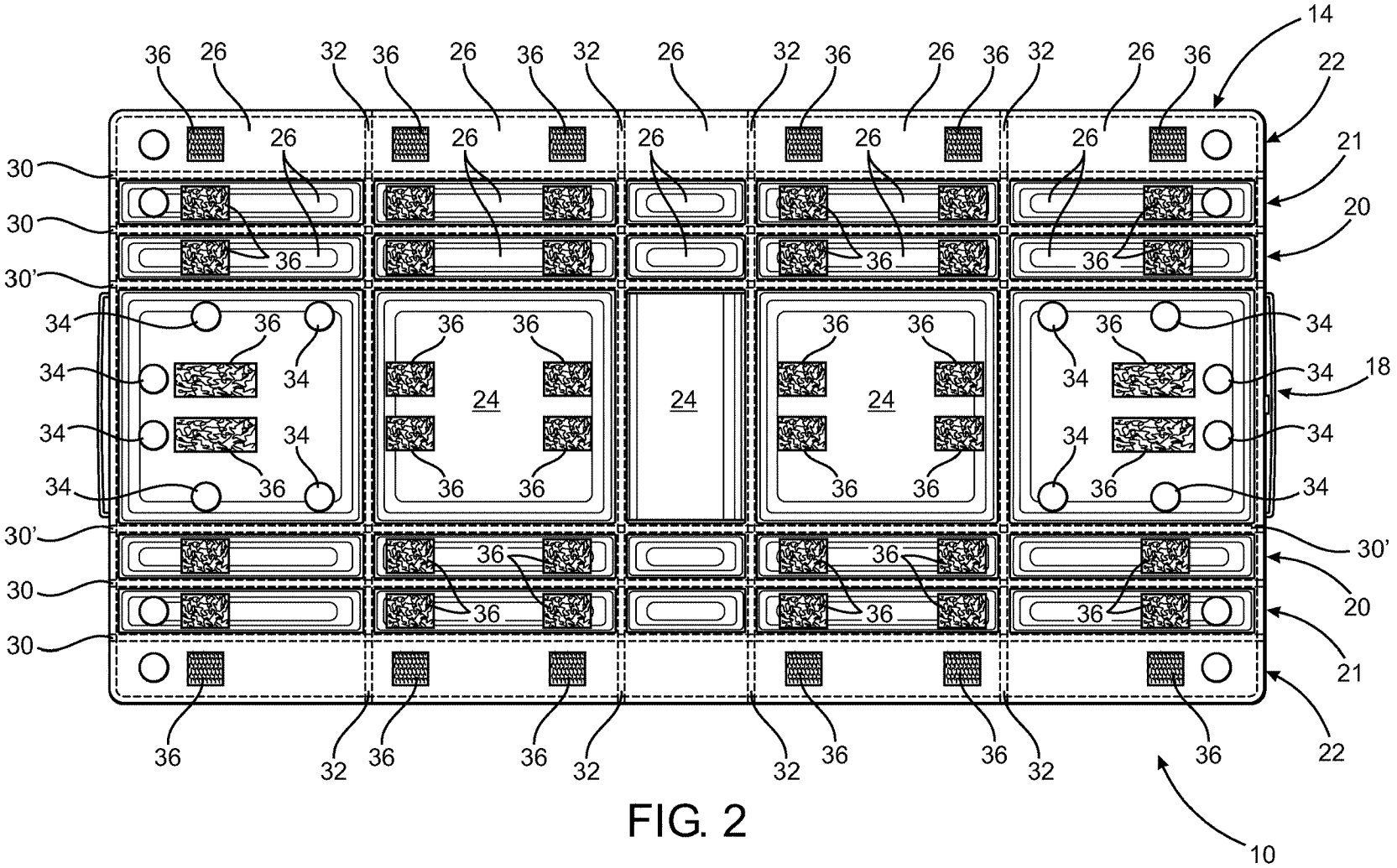
FIG. 2 is a plan view of an inside surface of one preferred embodiment of a base of the expanding assembly.
Figure 3:
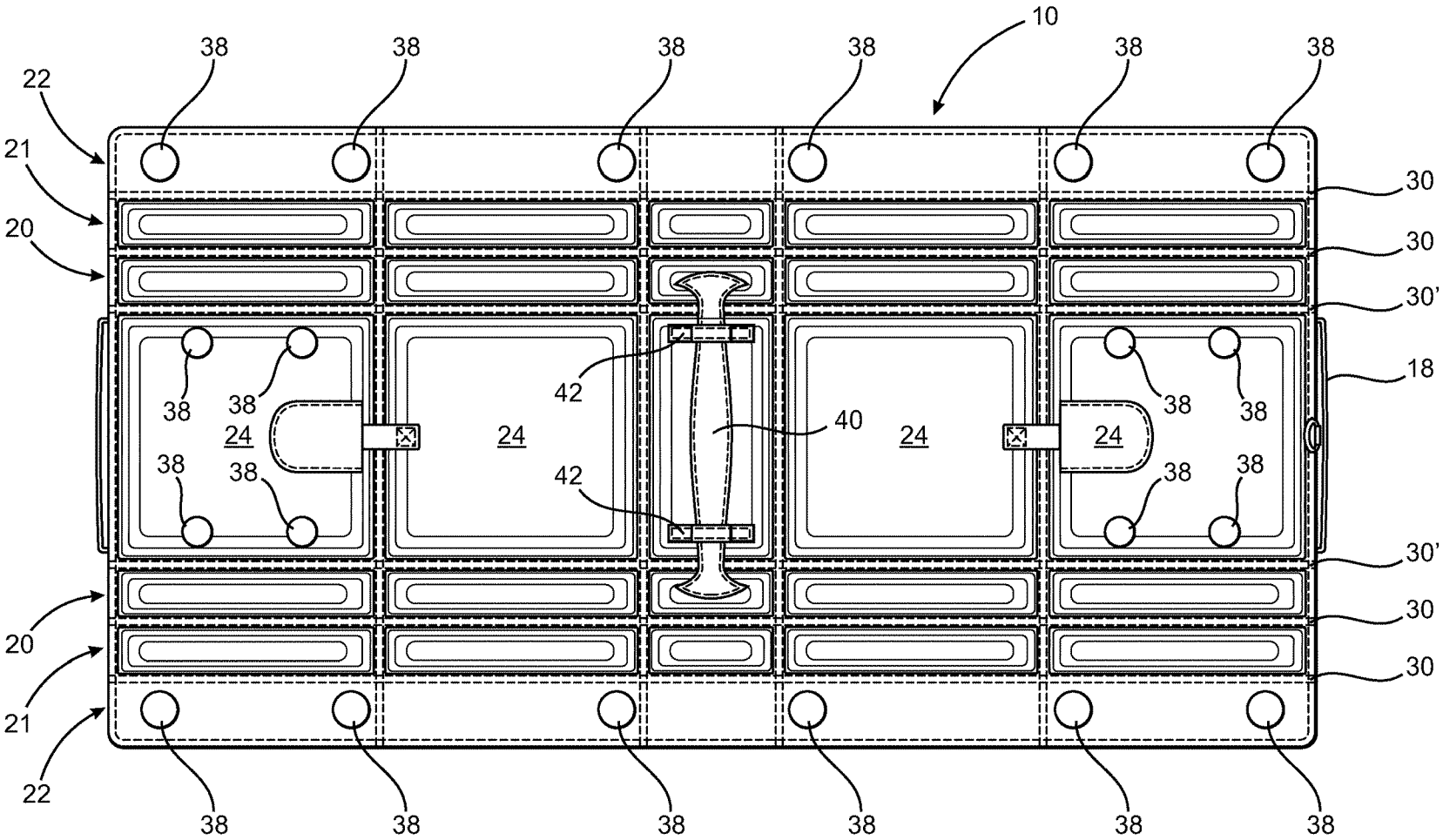
FIG. 3 is a plan view of the outside surface of the base of the embodiment of FIG. 2.

With primary reference to FIGS. 2 and 3, the base 12 includes an inner surface 14 represented in FIG. 2 and an outer surface 16 represented in FIG. 3. In addition, the base 12 includes a primary section generally indicated as 18 and at least one, but preferably a plurality of secondary sections 20, 21 and 22. As further represented, each of at least two secondary sections 20 are disposed in immediate, laterally adjacent relation to and extend along opposite longitudinal sides of the primary section 18. When the additional secondary sections 21 and 22 are included, the plurality of secondary sections 20, 21, 22 extend collectively along the length of the primary section 18 and one another, on opposite sides of the primary section 18. In addition, the plurality of secondary sections 20, 21 and 22 located on opposite longitudinal sides of the primary section 18 are also disposed in laterally adjacent relation to one another.

Further, the primary section 18 includes a plurality of primary segments 24 preferably successively extending in a common row in longitudinally adjacent relation to one another. Somewhat similarly, each of the plurality of secondary sections 20, 21 and 22 include a plurality of secondary segments 26. As represented, the plurality of secondary segments 26 of each of the secondary sections 20-22 also extend along common rows and are collectively disposed in a successive, longitudinally adjacent relation to one another.

In cooperation with the primary section 18 and the one or more secondary sections 20-22, the base 12 includes at least one, but preferably a plurality of longitudinal fold lines 30 and at least one, but preferably a plurality of transverse folded lines 32. As also represented in FIGS. 2 and 3, at least one of the plurality of longitudinal fold lines 30' and preferably two of such longitudinal fold lines 30' extend along the length of the primary section 18, on opposite sides thereof. As such, longitudinal fold lines 30' are disposed in interconnecting relation to a next adjacent one of the secondary sections 20. Accordingly, adjacent ones of the primary segments 24 and secondary segments 26 are pivotally or movably interconnected by the longitudinal fold lines 30'. Similarly, remaining ones of the longitudinal fold lines 30 extend along the length and serve to movably interconnect laterally adjacent ones of the remaining plurality of secondary sections 20-22.

Somewhat similarly, the transverse fold lines 32 extend through the primary section 18 and concurrently through the one or more secondary sections 20-22. As a result, longitudinally adjacent primary segments 24 are movably interconnected to one another by corresponding transverse fold lines 32. At the same time, the transverse fold lines 32 serve to movably interconnect longitudinally adjacent ones of the secondary segments 26 which are disposed in a common row associated with the secondary sections 20-22. The existence and locations of the plurality of longitudinal fold lines 30 and transverse fold lines 32, relative to the primary section 18 and the one or more secondary sections 20-22 facilitates numerous, different selective "folding patterns". Such a possible plurality of folding patterns is accomplished by folding the primary segments 24 and the secondary segments 26 relative to one another about correspondingly positioned ones of the longitudinal and transverse fold lines 30 and 32. As a result, portions of both the inner surface 14 and the outer surface 16 will be folded upon themselves in confronting engagement, as will be evident from the detailed description herein provided.

Therefore, the assembly 10 and the base 12 can be manipulated by a user into any one of a possible plurality of folded, operative orientations, so as to at least partially correspond the configuration of the base to that of the bag with which is to be used. As further noted, each or at least a majority of the possible plurality of folded orientations can also be defined by a plurality of portions of the inner surface 14 being folded upon itself when disposed in the selected one of the possible plurality of folded, operative orientations. At the same time, each or at least some of the possible plurality of folded, operative orientations will result in a plurality of portions of the outer surface 16 being folded upon itself, as clearly represented in at least FIG. 1.

Figure 1:
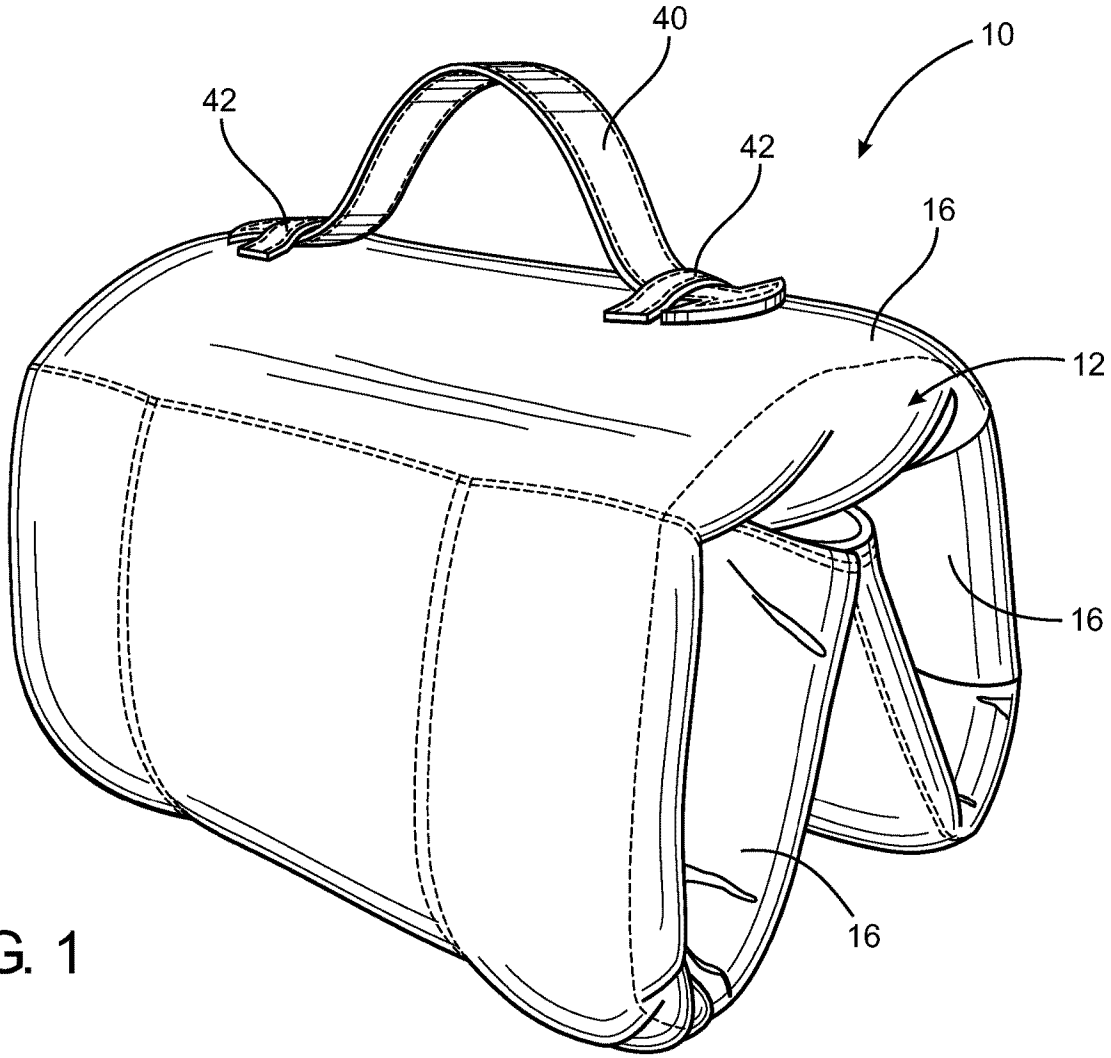
FIG. 1 is a perspective view of a preferred embodiment of the expanding assembly of the present invention in one of a possible plurality of folded, operative orientations.

Additional structural features which add to the versatility of the assembly 10 and a corresponding base 12 is the relative size and configuration of the primary segments 24 and the secondary segments 26. In at least one preferred embodiment, as represented in FIGS. 1-3, the locations of the transverse fold lines 32 define a substantially common length or longitudinal dimension of both the primary and secondary segments 24 and 26 respectively. However, due to the location of the plurality of longitudinal fold lines 30 and 30' the "width" or corresponding transverse dimension of the primary segments 24 may be significantly greater than that of the secondary segments 26. Further, in at least one preferred embodiment, at least some of the plurality of secondary segments 26 have a substantially common "width" or corresponding transverse dimension.

Also, a majority of the base 12 including some or at least a majority of the plurality of primary segments 24 and at least some and preferably a majority of the secondary segments 26 are at least partially formed of a compressible, expandable, cushioning material. Such material may be, but is not limited to, a compressible, ultralight, memory foam material which will expand into its original shape subsequent to being compressed. However, as represented in at least FIGS. 2 and 3 at least one preferred embodiment of the base 12 includes the outermost secondary sections 22 and corresponding secondary segments 26 having a non-compressible or minimally compressible, substantially flat structure and/or configuration. The formation of the outermost peripheral secondary segments 26 in this manner serves to facilitate interconnection of the corresponding outermost peripheral sections 22 with others of the plurality of primary and secondary sections 18, 20, 21, etc.

Yet additional structural features which facilitate and enhance versatility in folding the base 12, of one or more preferred embodiments of the expanding assembly 10, include a plurality of inner connectors 34 and 36 formed on the inner surface 14. In addition, a plurality of outer connectors 38 is formed on the outer surface 16. Further, the plurality of inner connectors 34 and 36 are disposed on the inner surface 14 in a first predetermined array and the plurality of outer connectors 38 are disposed on the outer surface 16 in a second predetermined array. Therefore, the first and second predetermined arrays of inner and outer connectors 34, 36 and 38 are cooperatively structured and/or configured to facilitate the removable connection of the base 12 into any one of a possible plurality of folded, operative orientations such as, but not limited to, those represented in FIGS. 1, 4E, 5 and 5A. Moreover, the first and second predetermined arrays may vary in configuration and/or structure dependent, at least in part, on the size, configuration, etc. of the base on which the inner and outer connectors, 34, 36 and 38, are mounted. The variance in the configuration or structure of the either of the first and second predetermined arrays allows the inner and outer connectors to be disposed in different locations on the inner and outer surfaces thereby further enhancing the versatility in folding the base 12 into any one of a possible plurality of folded, operative orientations.

Figure 6:
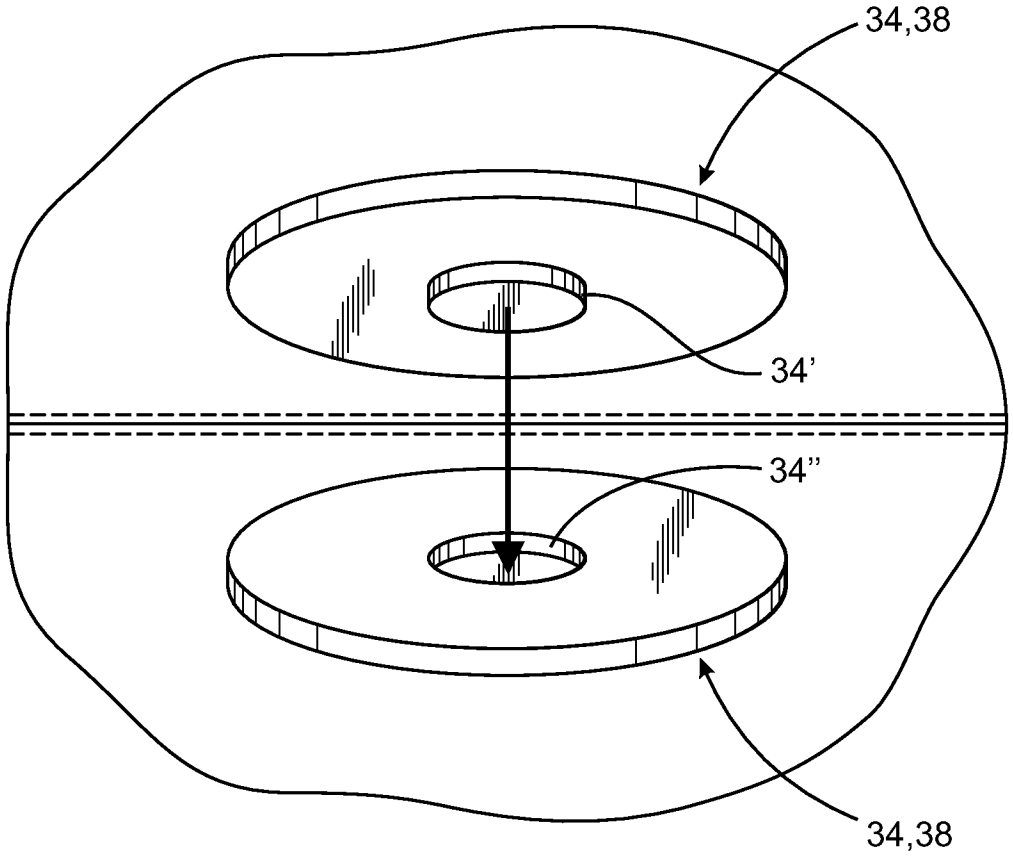
FIG. 6 is a detailed perspective view in partial cutaway of one of a plurality of connectors mounted on the base and used to maintain the base in a selected one of a possible plurality of folded, operative orientations.

As also represented the inner connectors 34 and 36 may be of different types or be defined by different structures. By way of example, and as represented in FIG. 6, the inner connectors 34, as well as at least some of the outer connectors 38, may include male and/or female configurations structured to define a "snap-fit" attachment with one another. As such, mating ones of the cooperatively structured inner and outer connectors 34 and 38 may have an outwardly projecting finger 34' and/or a receiving recess 34", for the insertion or receipt of a correspondingly positioned finger 34. In addition each of the inner connectors 34, as well as the outer connectors 38 may be formed of a metallic or other magnetic material and have magnetic characteristics facilitating the magnetic attraction of correspondingly positioned ones of the inner and outer connectors 34 and 38 to one another.

As set forth above and as also represented in FIG. 2 at least some of the inner connectors 36 may have a "hook and loop" type of construction, commercially known and made available under the trademark "Velcro". However, it is emphasized that at least one preferred embodiment of the present invention may include most or all of the inner connectors being of the same type or structure.

As represented in at least some of the accompanying Figures, other features associated with one or more preferred embodiments of the expanding assembly 10 and/or base 12 may include the provision of a handle 40 mounted on or connected to the exterior surface 16. More specifically, the handle or gripping member 40 may be located on the outer surface 16 at a location which facilitates the gripping, positioning and/or movement of the base 12 especially, but not exclusively, when it is in any one of the possible plurality of folded, operative orientations. Connecting straps or like attachment structures 42 may be appropriately connected to the outer surface 16 so as to removably or adjustably retain opposite ends of the handle 40 and thereby facilitate its attachment in the manner represented. Further, the handle 40 may be formed of an elastic and/or flexible material. In addition it is contemplated that at least some of the appropriate or preferred folded orientations of the base 12, will result in the handle 40 may be at least partially enclosed on the interior of the folded orientation. Therefore additional handles, gripping portions or tabs, etc. may be included at various locations on the base 12 in order to facilitate gripping and or manipulation of the base 12 when the primary handle 40 is at least partially non-accessible, based on it being enclosed within the interior of the folded orientation assumed by the base 12. FIG. 3 also depicts attachment members 44 at least initially disposed in spaced relation to one another on the outer surface 16. These attachment members 44 may be used to connect a removable spring-loaded attachment member 46 or other type of attachment in the manner represented in FIG. 4D. Further, the attachment member 46 may be removably secured to corresponding mounting or attachment members 44 or permanently secured thereto as desired.

Figure 4A:
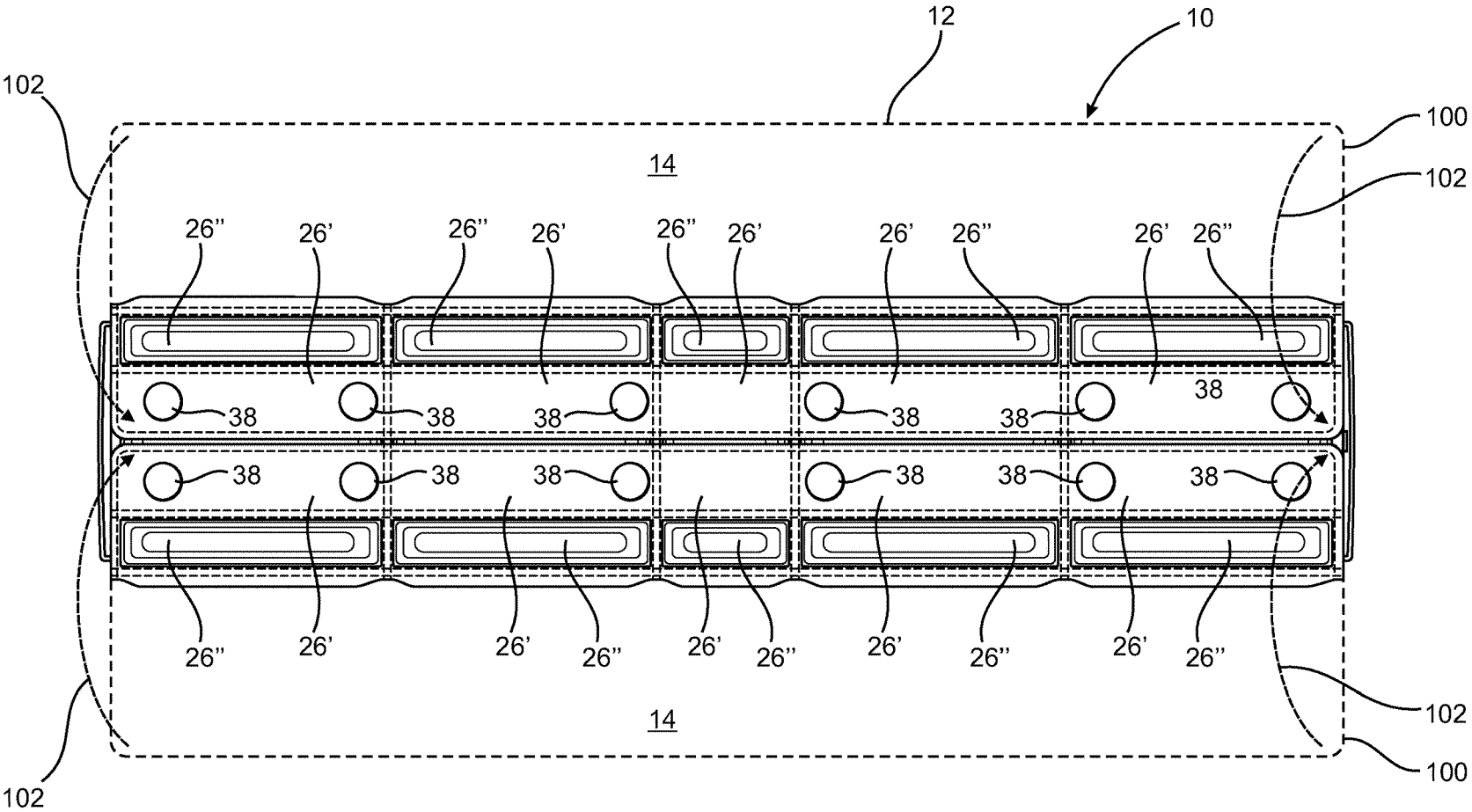
FIG. 4A is a plan view in partial phantom representing one of a possible plurality of steps of folding the base of the embodiment of FIGS. 1-3 into a predetermined one of a possible plurality of folded, operative orientations.
Figure 4B:
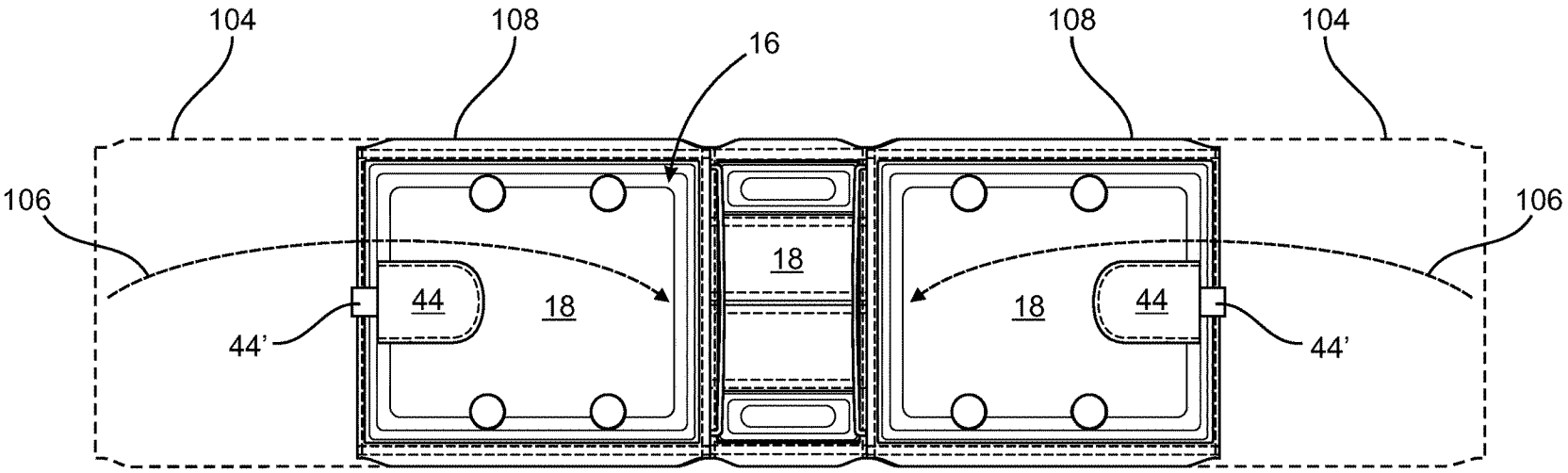
FIG. 4B is a subsequent folding step to that represented in FIG. 4A.
Figure 4D:
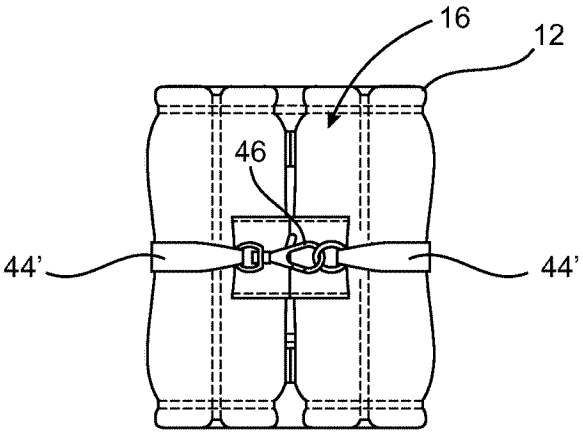
FIG. 4D is a bottom view of the base of the expanding assembly of the present invention when the folding steps of FIGS. 4A-4C have been completed.
Figure 4C:
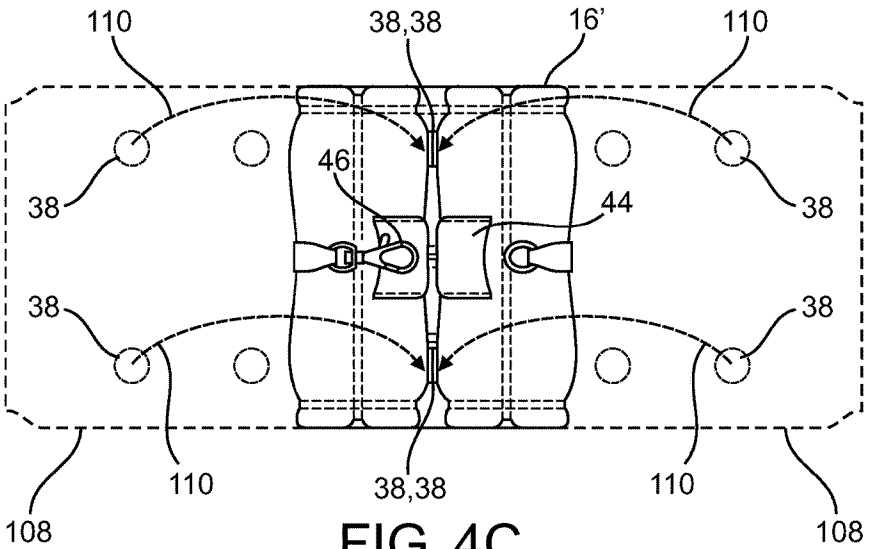
FIG. 4C is a subsequent folding step to that represented in FIG. 4A and FIG. 4B.
Figure 4E:
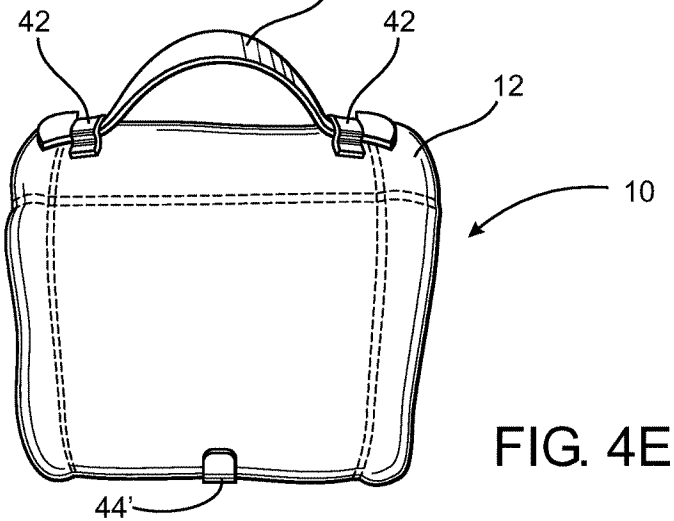
FIG. 4E is a perspective view of the expanding assembly of the present invention when arranged in a predetermined folded, operative orientation, after performing the successive folding steps of FIGS. 4A-4C.

For purposes of clarity, FIGS. 4A-4D are provided to schematically represent successive steps of folding the base 12 of at least one embodiment of the expanding assembly 10. Further by way of explanation, the substantially linear phantom lines are representative of a previous location of portions of the base 12 prior to the corresponding folding step. The curved or arcuate phantom lines are representative of the path of positioning of the components of the base 12 as they are being folded. It is emphasized that the folding steps of FIGS. 4A-4C are by way of example and representative only of the folding of the base 12 used to form the folded, operative orientation represented in FIGS. 4D and 4E. Accordingly, a different succession of folding steps may be applied to the base 12 in order to accomplish different ones of a possible plurality of folded, operative orientations as represented in FIGS. 1, 4D and/or FIGS. 5-5A.

Therefore, with primary reference to FIG. 4A, outer longitudinal peripheral portions 100 of the base 12 are folded inwardly as represented by directional arcuate lines 102. This will result in correspondingly disposed ones of the inner connectors 34 and 36 being brought into removable attachment with one another, as explained in detail with reference to FIG. 2. Once in the folded position of FIG. 4A, a portion of the outer surface 16 will be exposed on opposite sides of the folded base 10. This will result in the exposure of the outer surface 16 of the outermost peripheral secondary segments 26' and next laterally adjacent secondary segments 26". As represented in FIG. 4B, longitudinal portions 104 of the now partially folded base 12 will be folded inwardly in accord with arcuate directional fold lines 106. In this folded position outer surface portions 16, as represented FIG. 4A, will be folded upon themselves and be removably retained in such a folded orientation due to the removable interconnection of correspondingly positioned ones of the outer connectors 38. Upon accomplishing the folding step of FIG. 4B, the outer surface portions of primary segments 18 will be temporarily exposed as well attachment members 44.

FIG. 4C represents the outer surface portion 16', which is oppositely located on the opposite side of the base when it is in the partially folded orientation of FIG. 4B. As such, portions of the base 12, as at 108, represented in both FIGS. 4B and 4C are folded inwardly upon themselves. Further, and as represented by arcuate directional lines 110, upon completion of the folding step of FIG. 4C, the spring-loaded connector 46 may be attached as represented in the bottom view of FIG. 4D. This will serve to maintain the base 12 in the selected folded, operative orientation. Upon completion of the folding step FIG. 4C and securement of the base 12, as represented in FIG. 4D, the base 12 of the expanding assembly 10 will assume the selected folded, operative orientation of FIG. 4E and will at least partially correspond to the size and/or configuration of a bag in which it is to be inserted.

Figure 5A:
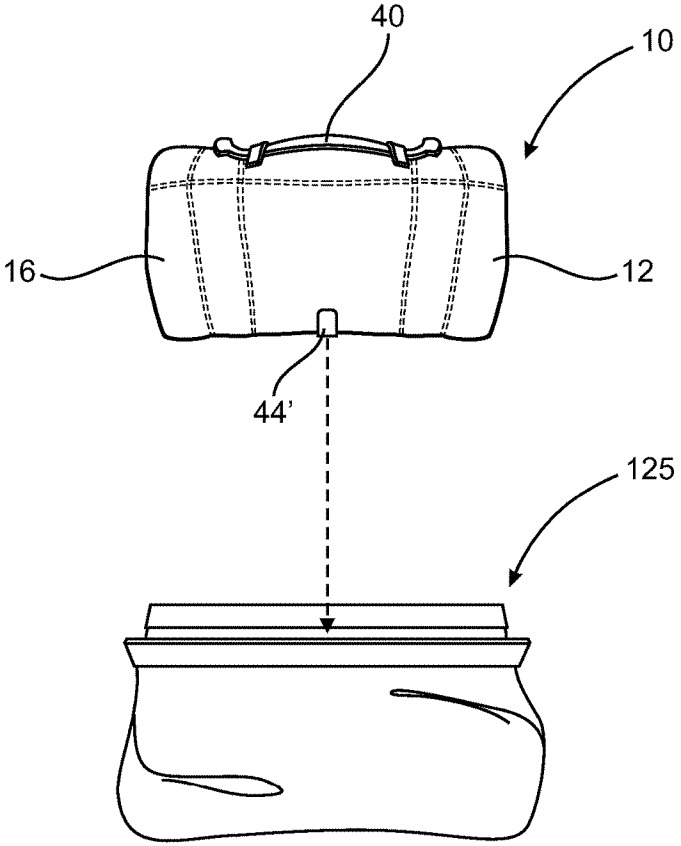
FIG. 5A is an exploded view of the expanding assembly of the present invention, wherein the base is being disposed in an operative position after it has been arranged in one of a possible plurality of folded, operative orientations, differing from that of the embodiment of FIG. 5, and at least partially corresponding to the configuration of the bag into which it is being inserted.
Figure 5:
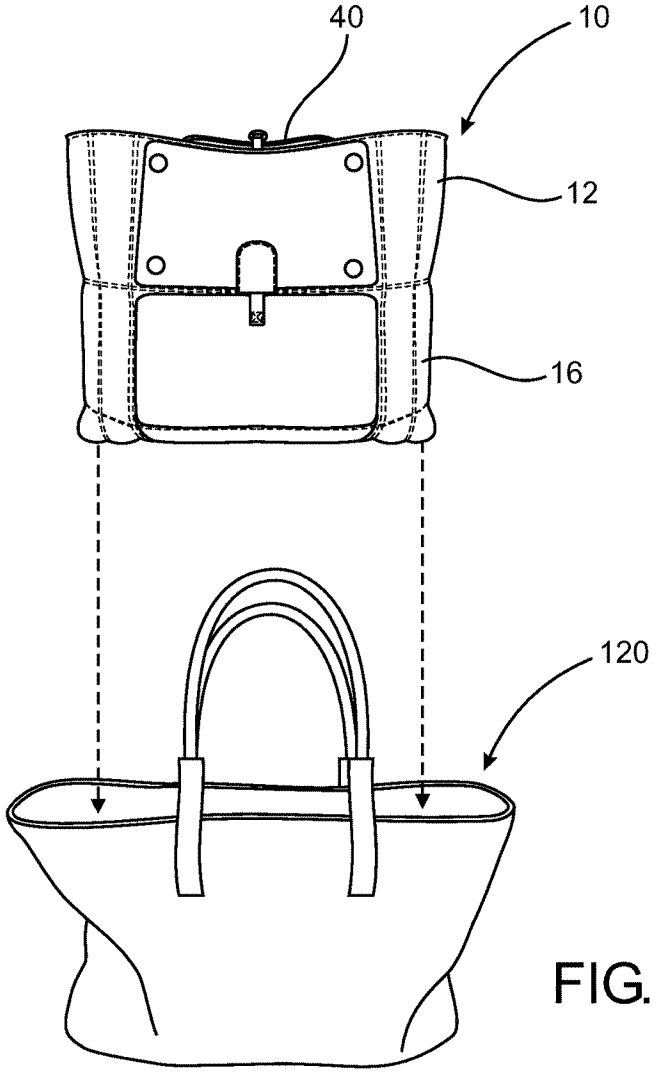
FIG. 5 is an exploded view of the expanding assembly of the present invention, wherein the base is being disposed in an operative position while arranged in one of a possible plurality of folded, operative orientations, which at least partially corresponds to the configuration of the bag in which it is to be inserted.

As emphasized herein, the base 12 may be manipulated through a variety of different folding steps in addition to, or other than, those represented in FIGS. 4A-4C. This will result in the ability of a user to fold the base 12 into any one of a variety of different folded, operative orientations as represented in FIGS. 1, 5 and 5A. Each of the selected ones of the possible plurality of folded, operative orientations will at least partially and sufficiently correspond to the overall configuration and/or interior configuration of the bags 120 and 125 in which they will be inserted in an operative position, to facilitate the maintenance of the bags 120 and 125 in an intended, expanded orientation. However, it is emphasized that the configuration of the bags 120 and 125 are representative only of a much larger number of configurations of various types of bags, with which the base 12 may be utilized, when the base is disposed in an operative position within a selected bag 120, 125, etc. Therefore, versatility of the various preferred embodiments of the bag expanding assembly 10 is demonstrated by the ability to use it with a variety of different types, structures and/or styles of bags. Structural variance in such bags may include, but is not limited to, bags having an open interior communicating with an open end of the bag. In contrast, the expanding assembly 10 of the present invention may be used with bag structures including a compartmented and/or at least partially enclosed interior of the bag.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. An assembly structured to maintain a bag in an expanded orientation when inserted therein, said assembly comprising:

a base formed of a foldable material and including an elongated inner surface and an elongated outer surface, said base further including at least one primary section and at least a first and a second plurality of secondary sections each disposed in laterally adjacent relation to said primary section, said primary section comprising a plurality of primary segments collectively extending along substantially an entirety of the length of said base in a successive, longitudinally adjacent disposition to one another, said at least one primary section and said at least first and second plurality of secondary sections extending along substantially the entirety of the length of said inner and outer surfaces, a plurality of longitudinal fold lines comprising at least a first, a second, a third, and a fourth longitudinal fold lines, said first longitudinal fold line extending between said at least one primary section and said first secondary section in interconnecting relation thereto, said second longitudinal fold line extending between said at least one primary section and said second secondary section in interconnecting relation thereto, said third longitudinal fold line extending between different adjacent ones of said first plurality of secondary sections in interconnecting relation thereto, said fourth longitudinal fold line extending between different adjacent ones of said second plurality of secondary sections in interconnecting relation thereto, at least one transverse fold line extending through said at least one primary section and said at least first and second plurality of secondary sections in interconnecting relation to adjacent portions of said at least one primary section and adjacent portions of said at least first and second plurality of secondary sections, a plurality of inner connectors disposed on said inner surface in a first predetermined array and a plurality of outer connectors disposed on said outer surface in a second predetermined array, said first and second predetermined arrays of connectors cooperatively configured to removably connect said base into any one of a plurality of folded, operative orientations, at least two of said plurality of primary segments of said primary section connected to one another by at least some of said outer connectors, and said base disposed in an operative position when in any one of said folded, operative orientations, said operative position comprising said base disposed within and in expanding relation to a correspondingly configured and dimensioned bag.

2. The assembly as recited in claim 1 wherein said base, including said at least one primary section and each of said at least first and second plurality of secondary sections, are formed of a compressible and expandable material.

3. The assembly as recited in claim 1 wherein said first predetermined array comprises said plurality of inner connectors disposed in a predetermined location on said primary section and on at least one of said at least first and second plurality of secondary sections.

4. The assembly as recited in claim 3 wherein at least a majority of said plurality of inner connectors are disposed in attachable relation with others of said plurality of inner connectors to define different ones of said plurality of folded, operative orientations of said base.

5. The assembly as recited in claim 4 wherein at least some of said plurality of inner connectors are disposed in attachable relation with said plurality of outer connectors to define different ones of said plurality of folded, operative orientations of said base.

6. The assembly as recited in claim 3 wherein at least some of said plurality of inner connectors are disposed in attachable relation with said plurality of outer connectors to define different ones of said plurality of folded, operative orientations of said base.

7. The assembly as recited in claim 3 wherein said predetermined second array comprises at least some of said outer connectors disposed on at least two different ones of said at least first and second plurality of secondary sections.

8. The assembly as recited in claim 7 wherein said predetermined second array further comprises at least some of said outer connectors disposed on said at least one primary section.

9. The assembly as recited in claim 1 wherein each of at least two of said at least first and second plurality of secondary sections extends along a length of a different opposite side of said at least one primary section in laterally adjacent relation thereto.

10. The assembly as recited in claim 9 wherein at least two of said at least first and second plurality of secondary sections are disposed along each opposite longitudinal side of said at least one primary section in laterally adjacent relation to one another and to said primary section.

11. The assembly as recited in claim 10 wherein different ones of said plurality of longitudinal fold lines extend in interconnecting relation between said at least one primary section and a next adjacent one of said plurality of secondary sections as well as adjacent ones of said plurality of secondary sections.

12. The assembly as recited in claim 9 wherein said first predetermined array comprises said plurality of inner connectors disposed in predetermined locations on said at least one primary section and said plurality of secondary sections.

13. The assembly as recited in claim 12 wherein different ones of said plurality of longitudinal fold lines extend in interconnecting relation between said at least one primary section and a next adjacent one of said plurality of secondary section as well as adjacent ones of said at least first and second plurality of secondary sections.

14. The assembly as recited in claim 9 wherein each of said at least first and second plurality of secondary sections comprises a plurality of secondary segments collectively extending along substantially an entirety of the length of said base in a successive, longitudinally adjacent disposition relative to one another.

15. The assembly as recited in claim 14 wherein different ones of said plurality of longitudinal fold lines extend in interconnecting relation between said at least one primary section and a next adjacent one of said at first and second plurality of secondary sections as well as adjacent ones of said at least first and second plurality of secondary sections.

16. The assembly as recited in claim 15 comprising a plurality of transverse fold lines extending concurrently between longitudinally adjacent ones of said plurality of primary segments and between longitudinally adjacent ones of said plurality of secondary segments.

17. The assembly as recited in claim 14 comprising a plurality of transverse fold lines extending concurrently between longitudinally adjacent ones of said plurality of primary segments and between longitudinally adjacent ones of said plurality of secondary segments.

18. The assembly as recited in claim 14 wherein at least a majority of said plurality of secondary segments include a length substantially equal to one another and to at least a majority of said plurality of primary segments.

19. The assembly as recited in claim 18 wherein at least a majority of said plurality of primary segments include a greater transverse dimension than at least a majority of said plurality of secondary segments.

20. The assembly as recited in claim 1 wherein at least some of said plurality of inner connectors comprise magnetic connectors.

21. The assembly as recited in claim 20 wherein at least some of said plurality of outer connectors comprise magnetic connectors.

22. The assembly as recited in claim 21 wherein at least some of said plurality of inner connectors comprise hook and loop fasteners.

23. The assembly as recited in claim 20 wherein at least some of said plurality of inner connectors comprise hook and loop fasteners.

24. The assembly as recited in claim 1 wherein at least some of said plurality of folded, operative orientations are at least partially defined by a plurality of portions of said inner surface being folded in confronting relation to themselves.

25. The assembly as recited in claim 24 wherein at least some of said plurality of folded, operative orientations are at least partially defined by a plurality of portions of said outer surface being folded in confronting relation to themselves.

26. An assembly structured to maintain a bag in an expanded orientation when inserted therein, said assembly comprising:

a base formed of a foldable material and including elongated inner and outer surfaces extending substantially along an entirety of the length of different opposite sides of said base, said base comprising a primary section and first and second secondary sections extending along the length thereof, said primary section comprising a plurality of primary segments collectively extending along substantially an entirety of the length of said base in a successive, longitudinally adjacent disposition to one another, at least a majority of said primary section and said first and second secondary sections formed of a compressible and expandable material, at least a first and a second longitudinal fold line each interconnecting a different one of said first and second secondary sections to a different longitudinal side of said primary section, a plurality of inner connectors disposed on said inner surface in a first predetermined array and a plurality of outer connectors disposed on said outer surface in a second predetermined array, said first and second predetermined arrays of connectors cooperatively configured to removably connect said base into any one of a plurality of folded, operative orientations, at least some of said plurality of folded, operative orientations comprising said inner surface being disposed in confronting engagement with itself, concurrent to at least some of said inner connectors attached to one another, at least two of said plurality of primary segments of said primary section connected to one another by at least some of said outer connectors, said outer surface being folded in confronting relation to itself, concurrent to at least some of said outer connectors attached to one another, and said base disposed in an operative position when in any one of said folded, operative orientations, said operative position comprising said base disposed within and in expanding relation to a correspondingly configured and dimensioned bag.

* * * * *